US005718950A

United States Patent [19]

Komatsu et al.

[11] Patent Number: 5,718,950

[45] Date of Patent: Feb. 17, 1998

[54] PROCESS FOR FORMATION OF MULTILAYER FILM

[75] Inventors: Yoshiharu Komatsu, Sayama; Tokio Suzuki; Mituru Muramoto, both of Kanuma, all of Japan

[73] Assignees: Kansai Paint Co., Ltd., Hyogo-ken; Honda Giken Kogyo Kabushiki Kaisha, Tokyo, both of Japan

[21] Appl. No.: 571,432

[22] Filed: Dec. 13, 1995

[30] Foreign Application Priority Data

Dec. 14, 1994 [JP] Japan ..... 6-332443

[51] Int. Cl.[6] ..... B05D 5/06; B05D 7/16

[52] U.S. Cl. ..... 427/405; 427/409; 427/419.3; 427/419.5

[58] Field of Search ..... 427/409, 410, 427/412.1, 412.3, 412.4, 412.5, 419.1, 419.2, 419.3, 419.4, 419.5, 419.6, 405

[56] References Cited

U.S. PATENT DOCUMENTS

| | | | |
|---|---|---|---|
| 4,539,258 | 9/1985 | Panush | 428/324 |
| 4,547,410 | 10/1985 | Panush et al. | 427/388.2 |
| 4,668,570 | 5/1987 | Esselborn et al. | 427/409 |
| 4,820,555 | 4/1989 | Kuwajima et al. | 427/409 |

FOREIGN PATENT DOCUMENTS

| | | |
|---|---|---|
| 0235646 | 9/1987 | European Pat. Off. . |
| 0358949 | 3/1990 | European Pat. Off. . |
| 0388931 | 9/1990 | European Pat. Off. . |

OTHER PUBLICATIONS

WPI Abstract Acc No. 93–299061/38 & JP 5–212345 A (Kansai Paint), Aug. 1993.

WPI Abstract Acc No. 88–288512/41 & JP 63–209772A (Kansai Paint), Aug. 1988.

*Primary Examiner*—Shrive Beck
*Assistant Examiner*—Erma Cameron
*Attorney, Agent, or Firm*—Wenderoth, Lind & Ponac

[57] ABSTRACT

The present invention provides a process for forming a multilayer film, by applying, onto a substrate, the following three coatings: (A) a coloring base coating containing a titanium white pigment and an aluminum flake and capable of forming a film having a value of N 7 to N 9 in Munsell's color system, (B) a white-pearl-like or silver-pearl-like base coating containing a scaly mica powder coated with titanium oxide, and (C) a clear coating in this order without substantially curing the resulting films of the coatings (A), (B) and (C); as necessary conducting preliminary drying at 50°–100° C. between the application of the coating (A) and the application of the coating (B) and/or between the application of the coating (B) and the application of the coating (C); and heating the three films to crosslink and cure them simultaneously. The multilayer film has excellent high white-iridescent appearance, color stability, etc.

18 Claims, No Drawings

PROCESS FOR FORMATION OF MULTILAYER FILM

The present invention relates to a process for forming a multilayer film superior in high white-iridescent appearance, color stability, etc. The process is suitably used for coating of, in particular, the body panel, color bumper, etc. of automobiles.

It is already a practice to form an iridescent film by the use of a coating containing a scaly mica powder coated with a metal oxide such as titanium oxide or the like. It is already known, for example, to form a multilayer film by applying, on a primer-coated surface, an organic solvent type base color capable of forming a film of N 4 to N 8 in Munsell's color system, then applying, without curing the above-applied base color, an organic solvent type transparent iridescent coating containing a mica powder coated with a metal oxide and also a clear coating, and heat-curing the above-applied three coatings simultaneously (see, for example, U.S. Pat. No. 4,539,258).

The multilayer film formed by the above approach, however, is insufficient in hiding power (color stability) for base color film (this necessitates the formation of the base color film in a large film thickness) and moreover inferior in high white-iridescent appearance. These drawbacks of the multilayer film are very serious when the multilayer film is formed on the body panel of an automobile wherein the appearance of the film is important. Hence, the drawbacks need be eliminated urgently.

The main object of the present invention is to eliminate the above-mentioned drawbacks in the iridescent multilayer film formed using a scaly mica powder coated with titanium oxide and provide a novel process for forming a multilayer film superior in color stability, high white-iridescent appearance, etc.

According to the present invention there is provided a process for forming a multilayer film, which comprises applying, onto a substrate, the following three coatings:

(A) a coloring base coating containing a titanium white pigment and an aluminum flake and capable of forming a film having a value of N 7 to N 9 in Munsell's color system, (B) a white-pearl-like or silver-pearl-like base coating containing a scaly mica powder coated with titanium oxide, and (C) a clear coating in this order without substantially curing the resulting films of the coatings (A), (B) and (C) and then heating the three films to crosslink and cure them simultaneously.

Detailed description is made below on the process for forming a multilayer film according to the present invention (the process is hereinafter referred to as "the present process").

In the present process, the coloring base coating (A) may be coated directly on a substrate (e.g. a plastic or a metal). It is generally preferred, however, that the substrate is beforehand coated with a primer (e.g. a cationic electrocoating), an intermediate coating, etc., followed by curing.

As the cationic electrocoating and the intermediate coating, there can be used those shown below.

Cationic electrocoating

The cationic electrocoating has no particular restriction as to its kind and can be a per se known cationic electrocoating obtained by mixing an aqueous solution or dispersion of a salt of a cationic polymer, as necessary with a pigment or additives. The cationic polymer includes, for example, an acrylic resin or epoxy resin which has a crosslinkable functional group and to which an amino group is introduced, and these resins are made water-soluble or water-dispersible by neutralization with an organic acid, an inorganic acid or the like. The crosslinking agent usable to cure said resin is preferably a blocked polyisocyanate, an alicyclic epoxy resin or the like.

In applying the cationic electrocoating, electrodeposition is conducted; that is, a metallic material as substrate (e.g. an automobile body panel or a color bumper) is immersed as a cathode in a bath consisting of said cationic electrocoating, and an electric current is passed between said cathode and an anode under ordinary conditions to precipitate the above-mentioned resin, etc. on the metallic material. The preferable thickness of the resulting electrocoating film is generally 10–40μ, more preferably 20–35μ as cured. The film can be crosslinked and cured by heating generally at about 140°–220° C. for about 10–40 minutes. In the present process, an intermediate coating may be applied before the cationic electrocoating is cured; however, it is generally preferable that the intermediate coating is applied after the cationic electrocoating has been cured.

Intermediate coating

The intermediate coating coated on the applied cationic electrocoating is a coating containing a resin component and a solvent, as main components, and as necessary a coloring pigment, an extender pigment, other additives for coating, etc. The intermediate coating is used for the improvement of the multilayer film to be obtained, in smoothness, distinctness of image gloss, gloss, etc.

The resin component used in the intermediate coating is preferably a thermosetting resin composition. A specific example of the composition is a combination of a base resin having a crosslinkable functional group (e.g. an acrylic resin, a polyester resin or an alkyd resin) and a crosslinking agent (e.g. a melamine resin, a urea resin or a blocked or non-blocked polyisocyanate compound). As the solvent, there can be used an organic solvent, water or a mixture thereof.

The intermediate coating can be applied on the film (crosslinked and cured, or uncured) of the cationic electrocoating by a method such as electrostatic coating, air spraying, airless spraying or the like. The preferable thickness of the applied intermediate coating is generally 10–50μ, particularly 25–50μ as cured. The film can be crosslinked and cured by heating generally at a temperature of about 100°–170° C. for about 10–60 minutes. In the present process, the coloring base coating (A), which is described below, may be applied while the film of the intermediate coating is still in an uncured state, but is preferably applied after the film of the intermediate coating has been crosslinked and cured.

Coloring base coating (A)

The coloring base coating (A) is a thermosetting coloring coating containing a titanium white pigment and an aluminum flake and capable of forming a film having a value of N 7 to N 9 in Munsell's color system. It can be applied directly onto a substrate, or onto the film of the above-mentioned intermediate coating.

The coloring base coating (A) is preferably a thermosetting coating containing, as essential components, a resin component, a solvent, a titanium white pigment and an aluminum flake and, as necessary, other coloring pigment, an extender pigment, additives for coating, etc.

The resin component used in the base coating (A) is preferably a thermosetting resin composition. A specific example thereof is a combination of a base resin having a crosslinkable functional group, such as acrylic resin, polyester resin, alkyd resin, urethane resin or the like and a crosslinking agent such as melamine resin, urea resin, blocked or non-blocked polyisocyanate compound or the like. The resin component is used by dissolving or dispersing it in a solvent such as organic solvent, water, mixture thereof or the like.

The titanium white pigment is a white pigment composed mainly of titanium dioxide. It is generally preferable that this pigment has an average particle diameter of 0.2–0.35μ, particularly 0.25–0.30μ. The aluminum flake is scaly metal aluminum. It is generally preferable that this aluminum flake has a thickness of 0.1–1μ, particularly 0.2–0.5μ, particle diameters of 1–20μ and an average particle diameter of 10μ or less.

The base coating (A) must contain the above-mentioned titanium white pigment and aluminum flake and moreover must be able to form a film having a value of N 7 to N 9, preferably N 7.5 to N 8.8 in Munsell's color system. To satisfy these requirements, it is generally preferable that the aluminum flake is used in an amount of preferably 0.5–10 parts by weight, particularly preferably 1–5 parts by weight per 100 parts by weight of the titanium white pigment, and that the total amount of the two components is 40–250 parts by weight, particularly 80–150 parts by weight per 100 parts by weight of the solid content of the resin component in the base coating (A). By controlling the titanium white pigment and the aluminum flake in such proportions, a film of a white to light gray color having no glitter can be formed. By coating, on such a film of the base coating (A), a white-pearl-like or silver-pearl-like base coating (B), a novel decorative multilayer film superior in high white-iridescent appearance, etc. can be formed.

The base coating (A) can be applied by a method such as electrostatic coating, air spraying, airless spraying or the like. The preferable thickness of the resulting film is generally 5–20μ, particularly 7–15μ as cured. The film can be crosslinked and cured at a temperature of about 100°–170° C.; in the present invention, however, the film is not crosslinked or cured and an iridescent base coating (B), which is described below, is applied thereon while the film is still in an uncrosslinked and uncured state.

White-pearl-like or silver-pearl-like base coating (B)

The base coating (B) is coated on the uncrosslinked and uncured film of the base coating (A). It is a liquid coating containing, as main components, a resin component, a scaly mica powder coated with titanium oxide, and a solvent and, as necessary, a coloring pigment, an extender pigment, additives for coating, etc.

The resin component used in the base coating (B) is preferably a thermosetting resin composition. A specific example thereof is a combination of a base resin having a crosslinkable functional group, such as acrylic resin, polyester resin, alkyd resin, urethane resin or the like and a crosslinking agent such as melamine resin, urea resin, blocked or non-blocked polyisocyanate compound or the like. The resin component can be used by dissolving or dispersing it in an organic solvent, water or a mixture thereof.

The scaly mica coated with titanium oxide, used in the base coating (B) is non-iridescent mica generally called "white mica" or "silver mica" and is distinguished from iridescent mica. The scaly mica powder whose particle surfaces are coated with titanium oxide, used in the present invention preferably has the maximum diameter of generally 5–60μ, particularly 5–25μ and a thickness of 0.25–1.5μ, particularly 0.5–1μ. In order for the film of the base coating (B) to have a white-pearl-like surface or a silver-pearl-like surface, it is preferable that the titanium oxide coated on the scaly mica powder generally has an optical thickness of 90–160 nm and a geometrical thickness of 40–70 nm.

There is no strict restriction as to the amount of the scaly mica coated with titanium oxide, but the preferable amount is generally 3–20 parts by weight, particularly 7–13 parts by weight per 100 parts by weight of the total solid content of the resin component in the base coating (B).

The pearl-like base coating (B) may further contain, as necessary, a silver-plated glass flake, titanium-coated graphite, a titanium flake, platy iron oxide, a phthalocyanine flake, etc.

The pearl-like base coating (B) can be coated on the uncrosslinked and uncured film of the coloring base coating (A) by a method such as electrostatic coating, air spraying, airless spraying or the like. The preferable thickness of the resulting film of the base coating (B) is 5–20μ, particularly 7–15μ as cured.

Incidentally, the preferable total thickness of the film of the coloring base coating (A) and the film of the pearl-like base coating (B) is generally 30μ or less, particularly 10–25μ as cured.

The film of the base coating (B) can be crosslinked and cured at a temperature of about 100°–170° C. In the present process, however, without substantially crosslinking and curing the film, a clear coating (C), which is described below, is coated thereon.

Clear coating (C)

The clear coating (C) is a liquid coating containing a resin component and a solvent as main components and further containing, as necessary, a coloring pigment, additives for coating, etc. to such an extent that the transparency of the film of the clear coating (C) is not impaired.

The resin component used in the clear coating (C) is preferably a thermosetting resin composition. A specific example thereof is a combination of a base resin having a crosslinkable functional group, such as acrylic resin, polyester resin, alkyd resin, urethane resin or the like and a crosslinking agent such as melamine resin, urea resin, blocked or non-blocked polyisocyanate compound or the like. As the solvent, there can be used an organic solvent, water or a mixture thereof. The film of the clear coating (C) can be crosslinked and cured at a temperature of about 100°–170° C.

The clear coating (C) can be coated on the uncrosslinked and uncured film of the pearl-like base coating (B) by a method such as electrostatic coating, air spraying, airless spraying or the like. The preferable thickness of the resulting film of the clear coating (C) is 10–100μ, particularly 20–50μ as cured.

In the present process, after the coloring base coating (A), the pearl-like base coating (B) and the clear coating (C) have been coated in this order, the resulting three films are heated at a temperature of about 100°–170° C., preferably 120°–150° C. for about 10–60 minutes to crosslink and cure them simultaneously.

The present process can be carried out generally by steps consisting of the application of the base coating (A)—room temperature standing (1)—the application of the base coating (B)—room temperature standing (2)—the application of the clear coating (C)—heating for curing. Optionally, the room temperature standing (1) and/or the room temperature standing (2) may be replaced by preliminary drying at about 50°–100° C., particularly at about 60°–80° C. This preliminary drying is preferably carried out to such an extent that the gel fraction of each film remains at 60% by weight or less, particularly at 50% by weight or less.

The following meritorious effects are provided by the present process.

(1) The coloring base coating (A) containing a titanium white pigment and an aluminum flake and thereby capable of forming a film having a value of N 7 to N 9 in Munsell's color system, has a very high hiding power. Therefore, the multilayer film formed by the present process is remarkably improved as compared to U.S. Pat. No. 4,532,258 in high white-iridescent appearance, color stability, etc. even when the total thickness of the film of the base coating (A) and the film of the base coating (B) is as small as 30μ or less.

(2) The scaly mica powder coated with titanium oxide, used in the pearl-like base coating (B) has a white pearl tone or a silver pearl tone. Therefore, the multilayer film formed by the present process is superior in high white-iridescent appearance, color stability, etc.

Thus, the process of the present invention can be favorably used for coating of the body panel, color bumper, etc. of automobiles.

The present invention is hereinafter described more specifically by way of Examples and Comparative Examples. In the following, parts and % are by weight unless otherwise specified.

I. SAMPLES (1) Cationic electrocoating

ELECRON 940OHB (trade name), a product of Kansai Paint Co., Ltd. containing an epoxy-polyamine type cationic resin and a blocked polyisocyanate compound (a curing agent).

(2) Intermediate coating

LUGABAKE PRIMER SURFACER GRAY (trade name), a product of Kansai Paint Co., Ltd. containing a polyester resin-melamine resin system and an organic solvent.

(3) Coloring base coatings (A-1) to (A-4)

(A-1) to (A-4) are each an organic solvent type coating containing a resin component (consisting of a hydroxyl group-containing acrylic resin and a melamine resin), a titanium white pigment, an aluminum flake and carbon black in the proportions shown in Table 1. In Table 1, the proportions of the hydroxyl group-containing acrylic resin and the melamine resin are expressed as the proportions of respective solid contents.

TABLE 1

| | Coloring base coating (A) | | | | |
|---|---|---|---|---|---|
| | (A-1) | (A-2) | (A-3) | (A-4) | (A-5) |
| Hydroxyl group-containing acrylic resin (*1) | 70 | 70 | 70 | 70 | |
| Melamine resin (*2) | 30 | 30 | 30 | 30 | |
| Titanium white pigment (*3) | 100 | 100 | 100 | 100 | 100 |
| Aluminum flake (*4) | 2.5 | 1.3 | 0 | 0 | 2.5 |
| Carbon black (*5) | 0 | 0 | 0.1 | 0.05 | 0 |
| N value in Munsell's color system | 8.4 | 8.8 | 8.4 | 8.8 | 8.4 |

(*1) Hydroxyl group-containing acrylic resin: hydroxyl value = 110, number-average molecular weight = 25,000

(*2) Melamine resin: butyl-etherified melamine resin (*3) Titanium white pigment: rutile type titanium oxide pigment, a product of TEIKOKU KAKO CO., LTD., particle diameter = 0.25–0.30μ

(*4) Aluminum flake: Non-reefing aluminum paste, a product of TOYO ALUMINUM K.K., thickness = 0.2–0.5μ, average particle diameter = 10μ or less (*5) Carbon black: BLACK PEARL S1300, a product of CABOT CO.

(4) Coloring base coating (A-5)

An aqueous emulsion type coating containing 100 parts by weight (as solid content) of a resin emulsion [consisting of 65 parts of a hydroxyl group-containing acrylic resin (*6), 15 parts of a urethane resin (*7) and 20 parts of a melamine resin (*8)], 100 parts of a titanium white pigment (*3 in Table 1) and 2.5 parts of an aluminum flake (*4 in Table 1). N value in Munsell's color system=8.4 as shown in Table 1.

(*6) Hydroxyl group-containing acrylic resin: an emulsion having an average particle diameter of 0.1 μm and a hydroxyl value of 30, neutralized with dimethylethanolamine.

(*7) Urethane resin: an emulsion obtained by means of chain extension reaction with water, neutralized with triethylamine.

(*8) Melamine resin: U-Van 28SE (trade name), a product of MITSUI TOATSU CHEMICALS, INC., a hydrophobic melamine resin.

(5) Pearl-like base coating (B-1)

An organic solvent type coating containing 70 parts of a hydroxyl group-containing acrylic resin (*9), 30 parts of a butylated melamine resin (*10) and 10 parts of scaly mica coated with titanium oxide [maximum diameter=10–20μ, thickness=0.5–1μ, optical thickness of titanium oxide=about 140 nm, geometrical thickness of titanium oxide=about 60 nm, IRIODIN 103R (trade name), a product of Merck Co.)]; solid content=20%.

(*9) Hydroxyl group-containing acrylic resin: hydroxyl value=100, number-average molecular weight=20,000.

(*10) Butylated melamine resin: a methyl- and butyl-etherifed melamine resin.

(6) Pearl-like base coating (B-2)

An aqueous coating containing 100 parts by weight (as solid content) of an aqueous resin emulsion [consisting of 65 parts of a hydroxyl group-containing acrylic resin (*11), 15 parts of a urethane resin (*12) and 20 parts of a melamine resin (*13)] and 10 parts of scaly mica coated with titanium oxide (IRIODIN 103R mentioned above); solid content=20%.

(*11) Hydroxyl group-containing acrylic resin: an emulsion having an average particle diameter of 0.1 μm and a hydroxyl value of 35, neutralized with dimethylethanolamine.

(*12) Urethane resin: an emulsion obtained by means of chain extension reaction with water, neutralized with triethylamine.

(*13) Melamine resin: U-Van 28SE (trade name), a product of MITSUI TOATSU CHEMICALS, INC., a hydrophobic melamine resin.

(7) Clear coating

LUGABAKE CLEAR (trade name), a product of Kansai Paint Co., Ltd., an acrylic resin-amino resin system, an organic solvent type.

II. EXAMPLES AND COMPARATIVE EXAMPLES

On a degreased and zinc phosphate-treated steel plate (JIS G 3141, 400 mm×300 mm×0.8 mm) was electrocoated, by an ordinary method, a cationic electrocoating so as to give a film of 20μ in thickness as cured. The coated cationic electrocoating was heated at 170° C. for 20 minutes for crosslinking and curing. On the cured film of the cationic electrocoating was coated an intermediate coating so as to give a film of 30μ in thickness as cured. The coated intermediate coating was heated at 140° C. for 30 minutes for crosslinking and curing.

On the cured film of the intermediate coating was coated one of the coloring base coatings (A-1) to (A-5) by the use of a minibell type rotary static electrocoating machine under the conditions of discharge amount=180 cc, 40,000 rpm, shaping pressure=1 kg/cm$^2$, gun distance=30 cm, conveyor speed=4.2 m/min, booth temperature=20° C. and booth humidity=75%. The thickness of the resulting film of the coloring base coating was 10μ as cured.

Then, on the uncured film of the coloring base coating was coated, in two stages, one of the iridescent base coatings (B-1) and (B-2) by the use of a REA gun under the conditions of discharge amount=180 cc, atomization pressure=2.5 kg/cm$^2$, pattern pressure=3.0 kg/cm$^2$, gun distance=35 cm, conveyor speed=4.2 m/min, booth temperature=20° C. and booth humidity=75%. The thickness of the resulting film of the iridescent base coating was 4–5μ as cured, in each stage and 8–10μ in total.

Then, on the uncured film of the iridescent base coating was coated a clear coating (C) by the use of a minibell type rotary static electrocoating machine under the conditions of discharge amount=320 cc, 40,000 rpm, shaping pressure=1.2 kg/cm$^2$, gun distance=30 cm, conveyor speed=4.2 m/min, booth temperature=20° C. and booth humidity=75%. The thickness of the resulting film of the clear coating (C) was 25μ as cured.

The resulting plate was allowed to stand in a room for 3 minutes and then heated at 140° C. for 30 minutes in a dryer of hot air circulation type to subject the three-layered films of the coloring base coating, the iridescent base coating and the clear coating simultaneously to crosslinking and curing, whereby various plates each having a multilayer film formed thereon were prepared.

The outline of the above coating operation is summarized in Table 2.

III. PERFORMANCES OF MULTILAYER FILMS

The plates each having a multilayer film formed thereon, prepared in Examples and Comparative Examples were measured for the performances of respective multilayer films. The results are shown in Table 2.

(*1) Hiding power for white and black substrate or film of intermediate coating

In accordance with the description made in JIS K 5400 "Hiding Power" was measured as the minimum thickness of the film of coloring base coating required to hide the white and black substrate used or the intermediate coating film formed. The smaller the minimum thickness, the higher the hiding power.

(*2) Iridescence feeling

SV (scatter value) and IV (intensity value) were measured using ALCOPE LMR 100 (trade name) (a product of Kansai Paint Co., Ltd.). SV is measured as follows. A laser beam is applied on a clear film at an incident angle of 45°; a reflected light of regular reflection territory, giving the minimum intensity is captured; the intensity of the light is converted to a signal output; and the signal output is converted to SV using a given formula. SV indicates the intensity (whiteness, degree of light scattering) of the diffuse reflection light generated by the striking of the laser beam upon scaly mica. A higher SV indicates a higher whiteness. IV is measured as follows. A laser beam is applied on a clear film at an incident angle of 45°; a reflected light of non-specular reflection territory, giving the maximum intensity is captured; the intensity of the light is converted to a signal output; and the signal output is converted to IV using a given formula. IV indicates the intensity (luminance, brightness and metallic luster) of the regular reflection light generated by the striking of the laser beam upon scaly mica. A higher IV indicates a higher metallic luster feeling.

(*3) Unevenness

Visually examined in a room by ten experienced testers in charge of testing film finish. The ratings by the ten testers were totalized, ○ indicates "good"; Δ indicates "borderline good"; and X indicates "bad".

What is claimed is:

1. A process for forming a multilayer film, which comprises applying, onto a substrate, the following three coatings:

TABLE 2

| | | Examples | | | Comparative Examples | |
|---|---|---|---|---|---|---|
| | | 1 | 2 | 3 | 1 | 2 |
| Cationic electrocoating | Trade name | ELECRON 9400 HB | | | | |
| | Curing | 170° C. × 20 min | | | | |
| Intermediate coating | Trade name | LUGABAKE PRIMER SURFACER | | | | |
| | Curing | 140° C. × 30 min | | | | |
| Coloring base coating | No. | A-1 | A-2 | A-5 | A-3 | A-4 |
| | Drying | W | W | H | W | W |
| Pearl-like base coating | No. | B-1 | B-1 | B-2 | B-1 | B-1 |
| | Drying | W | W | H | W | W |
| Clear coating | Trade name | LUGABAKE CLEAR | | | | |
| Curing | | 140° C. × 30 min | | | | |
| Performance test results | | | | | | |
| Hiding power for white and black substrate (μ) (*1) | | 9 | 10 | 9 | 20 | 20 |
| Hiding power for film of intermediate coating (μ) (*1) | | 8 | 9 | 8 | 18 | 18 |
| Iridescence feeling SV/IV (*2) | | 270/116 | 250/115 | 270/116 | 240/110 | 230/109 |
| Unevenness (*3) | | ○ | ○ | ○ | Δ | X |

In "Drying" of Table 2, W means to that the coated plate was allowed to stand at room temperature for 3–5 minutes, and H means to that the coated plate was dried at 60° C. for 10 minutes.

The performances of each multilayer film were measured by the following test methods.

(A) a coloring base coating containing a resin component, a titanium white pigment and an aluminum flake to form a film, the amounts of the titanium white pigment and aluminum flake being such that the film has a value of N 7 to N 9 in Munsell's color system, (B) a film-forming white-pearl or silver-pearl base coating containing a resin component and a scaly mica powder coated with titanium oxide wherein the titanium oxide has a geometrical thickness of 40–70 nm, and (C) a film-forming clear coating in this order without substantially curing the resulting films of the coatings (A), (B) and (C) and then heating the three films to crosslink and cure them simultaneously.

2. A process according to claim 1, wherein prior to the application of the coloring base coating (A), a cationic electrocoating and an intermediate coating are applied onto the substrate in this order.

3. A process according to claim 1, wherein the coloring base coating (A) forms a colored film having a value of N 7.5 to N 8.8 in Munsell's color system.

4. A process according to claim 1, wherein the titanium white pigment has an average particle diameter of 0.2–0.35μ.

5. A process according to claim 1, wherein the aluminum flake has a thickness of 0.1–1μ, particle diameters of 1–20μ and an average particle diameter of 10μ or less.

6. A process according to claim 1, wherein the coloring base coating (A) contains the aluminum flake in an amount of 0.5–10 parts by weight per 100 parts by weight of the titanium white pigment.

7. A process according to claim 1, wherein the coloring base coating (A) contains the aluminum flake in an amount of 1–5 parts by weight per 100 parts by weight of the titanium white pigment.

8. A process according to claim 1, wherein the coloring base coating (A) contains the titanium white pigment and the aluminum flake in a total amount of 40–250 parts by weight per 100 parts by weight of the solid content of the resin component.

9. A process according to claim 1, wherein the film of the coloring base coating (A) has a thickness of 5–20μ as cured.

10. A process according to claim 1, wherein the scaly mica powder coated with titanium oxide is non-iridescent.

11. A process according to claim 1, wherein the scaly mica powder coated with titanium oxide has the maximum diameter of 5–60μ and a thickness of 0.25–1.5μ.

12. A process according to claim 1, wherein the scaly mica powder coated with titanium oxide is coated with titanium oxide in an optical thickness of 90–160 nm and a geometrical thickness of 40–70 nm.

13. A process according, to claim 1, wherein the coating (B) contains the scaly mica powder coated with titanium oxide, in an amount of 3–20 parts by weight per 100 parts by weight of the solid content of the resin component.

14. A process according to claim, 1, wherein the film of the coating (B) has a thickness of 5–20μ as cured.

15. A process according to claim 1, wherein the total thickness of the film of the base coating (A) and the film of the coating (B) is 30μ or less as cured.

16. A process according to claim 1, wherein the film of the clear coating (C) has a thickness of 10–100μ as cured.

17. A process according to claim 1, wherein the films of the coatings (A), (B) and (C) are heated at a temperature of about 100° to about 160° C. to crosslink and cure said films simultaneously.

18. A process according to claim 1, wherein preliminary drying is conducted at a temperature of about 50° to about 100° C. between the application of the coloring base coating (A) and the application of the white-pearl or silver-pearl base coating (B) and/or between the application of the white-pearl or silver-pearl base coating (B) and the application of the clear coating (C).

* * * * *